US006724853B2

(12) United States Patent
Gluschke et al.

(10) Patent No.: US 6,724,853 B2
(45) Date of Patent: Apr. 20, 2004

(54) LIFTING LUG FOR NUCLEAR-WASTE CONTAINER

(76) Inventors: Konrad Gluschke, Weberstrasse 11, D-58739 Wickede (DE); Dieter Methling, Kehre 9, D-45525 Hattingen (DE)

( * ) Notice: Subject to any disclaimer, the term of this patent is extended or adjusted under 35 U.S.C. 154(b) by 44 days.

(21) Appl. No.: 10/278,002

(22) Filed: Oct. 22, 2002

(65) Prior Publication Data

US 2003/0128796 A1 Jul. 10, 2003

(30) Foreign Application Priority Data

Oct. 23, 2001 (EP) ..... 01125521

(51) Int. Cl.[7] ..... G21F 5/06; G21F 5/08; G21F 5/14

(52) U.S. Cl. ..... 376/272; 250/506.1; 250/507.1; 250/515.1; 588/1

(58) Field of Search ..... 376/272; 250/506.1, 250/507.1, 515.1; 588/1

(56) References Cited

U.S. PATENT DOCUMENTS

| | | | | | |
|---|---|---|---|---|---|
| 4,336,460 | A | * | 6/1982 | Best et al. | 250/506 |
| 4,447,729 | A | * | 5/1984 | Doroszlai et al. | 250/506.1 |
| 4,666,659 | A | * | 5/1987 | Lusk et al. | 376/272 |
| 4,680,159 | A | * | 7/1987 | Lahr et al. | 376/272 |
| 4,842,815 | A | * | 6/1989 | Cauquelin et al. | 376/463 |
| 5,102,615 | A | * | 4/1992 | Grande et al. | 376/272 |
| 5,513,232 | A | * | 4/1996 | Jones et al. | 376/272 |
| 5,546,436 | A | * | 8/1996 | Jones et al. | 376/272 |

FOREIGN PATENT DOCUMENTS

| | | | | |
|---|---|---|---|---|
| DE | 3015553 | * | 10/1981 | 376/272 |
| DE | 3615588 | * | 11/1987 | 376/272 |
| FR | 2455203 | * | 12/1980 | 376/272 |
| JP | 01-305398 | * | 12/1989 | 376/272 |
| JP | 2000-193790 | * | 7/2000 | 376/272 |
| JP | 2001-133589 | * | 5/2001 | 376/272 |
| JP | 2002-174694 | * | 6/2002 | 376/272 |
| WO | 95/10837 | * | 4/1995 | 376/272 |

* cited by examiner

*Primary Examiner*—Jack Keith
(74) *Attorney, Agent, or Firm*—Herbert Dubno; Andrew Wilford

(57) ABSTRACT

A lifting lug for a nuclear-waste container has a tubular body having an inner end formed with a flange adapted to be bolted to the container and a transverse wall set in and tightly fitted to a smaller-diameter outer end of the tubular body. The wall is a separate piece from the body and is press-fitted to the tubular body. The wall is mounted at a load point of the lifting lug. In addition the wall is formed of a disk and/or a ring, typically as one unitary piece with the disk and ring spaced from each other.

5 Claims, 1 Drawing Sheet

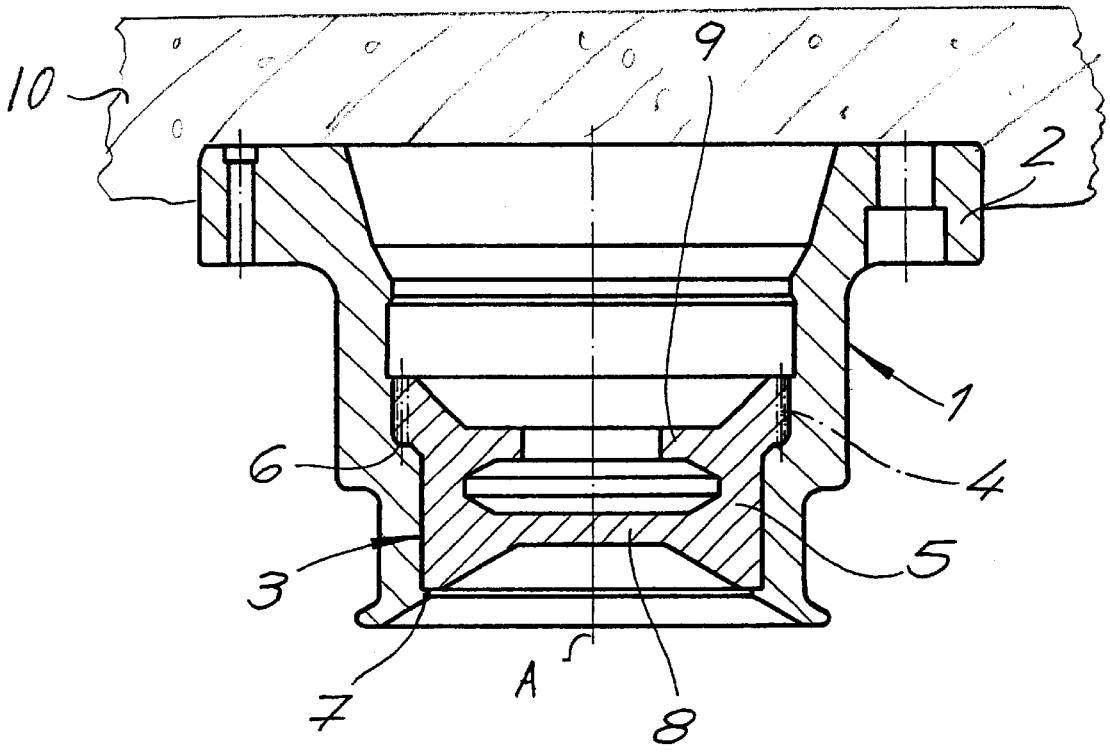
10
9
2
1
6
4
3
5
7
A
8

LIFTING LUG FOR NUCLEAR-WASTE CONTAINER

FIELD OF THE INVENTION

The present invention relates to nuclear-waste container. More particularly this invention concerns a lifting lug for such a container.

BACKGROUND OF THE INVENTION

A standard nuclear-waste container lifting lug as described in U.S. Pat. No. 4,680,159 of Lahr is a tubular, hollow, and cylindrical body with an end flange by means of which the lifting lug is bolted to side of the nuclear-waste container and which has a transverse wall in the cylindrical body. When the flange is bolted to the side of the normally cylindrical nuclear-waste container, the cylindrical body of the lug projects radially outward from the container so the lug can be engaged by, for instance, a hook of a lifting rig, allowing the container to be handled with ease.

In the known lifting lug the transverse wall is normally formed of a disk or ring that is unitary with the cylindrical body. As a result of this mainly hollow construction there is some deformability in the case of an accident, so that the lug will not under any circumstances be driven into the container but instead will at worse be crushed. On the other hand, the transverse wall limits ovalizing or other radial deformation of the hollow cylindrical body when the massive container is being lifted by it. The known one-piece unitary construction is a tradeoff erring on the side of excessive rigidity.

OBJECTS OF THE INVENTION

It is therefore an object of the present invention to provide an improved lifting lug for a nuclear-waste container.

Another object is the provision of such an improved lifting lug for a nuclear-waste container which overcomes the above-given disadvantages, that is which does not deform during normal use, but which can deform in the event of an accident.

SUMMARY OF THE INVENTION

A lifting lug for a nuclear-waste container has according to the invention a tubular body having an end formed with a flange adapted to be bolted to the container and a transverse wall set in and tightly fitted to the tubular body. The wall is a separate piece from the body.

The advantage of this system is that the transverse wall serves during normal transport the same function as the known transverse wall, that is rigidifies the tubular body and prevents it from being flattened by the lifting hook. In addition however, when there is a perpendicular blow on the lifting lug the transverse wall does not function any longer and does not prevent deformation of the lifting lug. It will be crushed rather than driven through the container wall.

Furthermore according to the invention the wall is press-fitted to the tubular body and extends perpendicular across its axis. The body has an outer end smaller than the inner end formed with the flange and it is this smaller outer end of the body that holds the wall. The wall is mounted at a load point of the lifting lug, that is where a lifting hook will actually engage around the lug. In addition the wall is formed of a disk and/or a ring, typically as one unitary piece with the disk and ring spaced from each other. The wall has a thickness determined by the maximum permissible surface pressure.

BRIEF DESCRIPTION OF THE DRAWING

The above and other objects, features, and advantages will become more readily apparent from the following description, reference being made to the accompanying drawing whose sole FIGURE is a section through the lifting lug according to the invention.

SPECIFIC DESCRIPTION

As seen in the drawing the lifting lug for a nuclear-waste container 10 according to the invention has a tubular body 1 centered on an axis A and having at an inner end a radially outwardly projecting mounting flange 2 for bolting to the container 10. In addition the body 1 has at a smaller-diameter outer end a transverse wall 3.

This transverse wall 3 in accordance with the invention is formed by a separate wall or support piece 5 press-fitted into the cylindrically tubular body 1 and, like the body 1, rotation symmetrical to the axis A. The support piece 5 is pushed axially from the inner end having the flange 2 so as to fit against shoulders or steps 6 and 7 at an outer end of the body 1 in a tight force-fit and has bores 4 for venting the space defined by the step 6 when the piece 5 is pressed into place. The piece 5 is mounted at the load-bearing region of the lifting lug 1 and has a thickness determined by the permissible surface pressure. As shown in the drawing, the piece 5 is formed mainly as a disk 8 and a ring 9 spaced from it. The disk 8 and the ring 9 thus form the one-piece support piece 5.

The container 10 normally has two such lugs projecting diametrally oppositely from each other and is lifted and moved by a rig having a pair of hooks that engage the two lugs. During such lifting each tubular body 1 is braced internally by the respective support piece 5 so that, even though it is being subjected to enormous radial compression, it does not deform and ovalize. On the other hand if there is an accident and the container 10, for instance, is dropped or knocked over and subjected to a load directed along the axis A toward the container, the tubular body 1 will crush and deform rather than be driven through and compromise the structural integrity of the container. The press-fitted piece 5 will not resist such axial deformation significantly, making the lug according to the invention as resistant to radial deformation during normal use as the prior-art lug, but less resistant to axial deformation in the event of an accident.

We claim:

1. A lifting lug for a nuclear-waste container, the lifting lug comprising:

a tubular body having an inwardly open large-diameter inner end formed with a flange adapted to be bolted to the container, an outwardly open small-diameter outer end, and a step between the ends; and a transverse wall tightly fitted to the tubular body between the inner and outer ends and bearing outwardly on the step, the wall being a separate piece from the body.

2. The waste-container lifting lug defined in claim 1 wherein the wall is press-fitted to the tubular body.

3. The waste-container lifting lug defined in claim 1 wherein the wall is mounted at a load point of the lifting lug.

4. The waste-container lifting lug defined in claim 1 wherein the wall is formed of a disk and a ring.

5. The waste-container lifting lug defined in claim 1 wherein the body is centered on an axis, the wall being a body of revolution also centered on the axis.

* * * * *